US009162504B2

(12) United States Patent
Tanaka et al.

(10) Patent No.: US 9,162,504 B2
(45) Date of Patent: Oct. 20, 2015

(54) RECORDING APPARATUS

(71) Applicant: SEIKO EPSON CORPORATION, Tokyo (JP)

(72) Inventors: Daisuke Tanaka, Shiojiri (JP); Minoru Kishigami, Matsumoto (JP); Shota Mizuno, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,058

(22) Filed: Mar. 24, 2014

(65) Prior Publication Data

US 2014/0292927 A1 Oct. 2, 2014

(30) Foreign Application Priority Data

Mar. 29, 2013 (JP) ..... 2013-071602
Sep. 18, 2013 (JP) ..... 2013-192660

(51) Int. Cl.
*B41J 29/02* (2006.01)
*B41J 2/175* (2006.01)

(52) U.S. Cl.
CPC . *B41J 29/02* (2013.01); *B41J 2/175* (2013.01)

(58) Field of Classification Search
None
See application file for complete search history.

(56) References Cited

U.S. PATENT DOCUMENTS

2007/0146445 A1 6/2007 Nukui et al.

FOREIGN PATENT DOCUMENTS

| | | |
|---|---|---|
| EP | 1864816 | 12/2007 |
| JP | 2007-136785 | 6/2007 |
| JP | 2007-144776 | 6/2007 |
| JP | 4135751 | 6/2008 |
| JP | 4730089 | 4/2011 |
| JP | 2013-075436 | 4/2013 |

*Primary Examiner* — Justin Seo
(74) *Attorney, Agent, or Firm* — Workman Nydegger

(57) ABSTRACT

A recording apparatus includes a carriage that is movable in a reciprocating manner with a recording head being mounted on the carriage, a tube that is capable of supplying ink to the recording head in a curved state and is capable of being deformed in curvature in response to a reciprocating motion of the carriage, an arm that is swingably movable about a swing shaft which extends in a direction perpendicular to a plane formed by the curved tube and is capable of supporting the tube, and a connecting section that has a holding section which holds the tube and is configured to support the tube by the arm, wherein the connecting section is movable relative to the arm in response to the reciprocating motion of the carriage.

5 Claims, 18 Drawing Sheets

RECORDING APPARATUS

BACKGROUND

1. Technical Field

The present invention relates to a recording apparatus which includes an ink supply tube whose curvature can be deformed in response to a reciprocating motion of a carriage.

2. Related Art

A recording apparatus which includes an ink supply tube whose curvature can be deformed in response to a reciprocating motion of a carriage has been disclosed. In such a recording apparatus, the curvature of the ink supply tube is discontinuously deformed in response to the reciprocating motion of the carriage, which leads to a large curvature change. This may have an effect, for example, that the carriage is subject to vibration, or an excessive load is applied to the carriage. Accordingly, various techniques to suppress the effect on the carriage due to the deformation in curvature of the ink supply tube are disclosed.

For example, JP-A-2007-144776 discloses a recording apparatus which includes an arm having a regulating section that regulates the movement of the ink supply tube in the vertical direction and a regulating section that regulates the movement of the ink supply tube in the horizontal direction. The arm is swingably movable about a pivot shaft.

Further, JP-A-2007-136785 discloses a recording apparatus in which an ink supply tube is supported by a magnetic material member and the position of the ink supply tube is regulated by the magnetic material member. Magnets are arranged on the main body of the recording apparatus and, as the carriage moves, the magnets sequentially attract the magnetic material member.

In the recording apparatus disclosed in JP-A-2007-144776, the regulating sections are integrally formed with the arm. That is, the regulating sections are fixed to the distal end of the swingably movable arm. Further, the ink supply tube is nipped between the regulating sections. Accordingly, a portion of the ink supply tube which is nipped by the regulating sections is supported by the arm at the distal end of the arm in the nipped state. When the ink supply tube is deformed in curvature in response to the reciprocating motion of the carriage, the arm swings about the pivot shaft while supporting the ink supply tube. In so doing, as the ink supply tube is deformed in curvature, an excessive force may be applied to the portion of the ink supply tube which is nipped by the regulating sections, since the regulating sections are fixed to the arm. As a result, the ink supply tube cannot be smoothly deformed in curvature, which may cause a reaction force to disturb a behavior of the carriage. Further, when the arm swings, an excessive force is repeatedly applied to the same position or the same area of the ink supply tube. This may lead to abrasion or deterioration of the nipped portion of the ink supply tube.

In the recording apparatus disclosed in JP-A-2007-136785, when the magnets and the magnetic material member have weak magnetic force, the magnets may fail to attract the magnetic material member. On the other hand, when the magnets and the magnetic material member have strong magnetic force, an excessive load may be applied to the carriage. Accordingly, in the recording apparatus which includes the ink supply tube whose curvature can be deformed in response to a reciprocating motion of the carriage, it has been difficult to suppress the effect on the carriage due to the deformation in curvature of the ink supply tube.

SUMMARY

An advantage of some aspects of the invention is that the ink supply tube whose curvature can be smoothly deformed in response to the reciprocating motion of the carriage is provided, thereby suppressing the effect on the behavior of the carriage.

According to a first aspect of the invention, a recording apparatus includes a housing; a recording head that is disposed in the housing and is capable of recording by ejecting ink onto a recording medium; a carriage that is movable in a reciprocating manner with the recording head being mounted on the carriage; an ink storing unit that is disposed outside of the carriage; a flexible tube that deforms in response to a movement of the carriage and through which ink contained in the ink storing unit is supplied to the recording head; a frame that is disposed in the housing; a flexible member guiding section that is fixed to the frame; an arm that is disposed on the flexible member guiding section, supports the tube, and is swingably movable in response to the movement of the carriage; and a connecting section that has a holding section which holds the tube and supports the tube in a manner movable relative to the arm.

The phrase "the connecting section that supports the tube in a manner movable relative to the arm" means a configuration in which the connecting section is fixed to the tube and is movable with the tube relative to the arm as well as a configuration in which the connecting section is not fixed to the tube and is movable relative to the tube and the arm.

Accordingly, the connecting section is movable relative to the arm in response to the movement of the carriage. Therefore, when the tube is deformed (deformed in curvature of the ink supply tube) in response to the reciprocating motion of the carriage, an excessive force is not applied to a portion of the tube which is held by the holding section, unlike in the case of a fixed configuration. As a result, the curvature can be smoothly deformed, thereby reducing an effect on the behavior of the carriage due to the deformation in curvature of the tube. Further, when the arm swings, an excessive force is not repeatedly applied to the same position or the same area of the tube. This may prevent abrasion or deterioration of the portion of the tube which is held by the holding section.

It is preferable that the connecting section is variable in orientation in response to the reciprocating motion of the carriage.

Accordingly, when the tube is deformed in curvature in response to the reciprocating motion of the carriage, the connecting section can move with respect to the arm and also change its orientation. As a result, the curvature can be further smoothly deformed, thereby further reducing an effect on the behavior of the carriage.

It is preferable that the arm is disposed outside with respect to the curved tube, and the recording apparatus further includes a biasing section that biases the arm toward the outside.

The phrase "the arm is disposed outside with respect to the curved tube" means a configuration in which an entire arm is disposed outside with respect to the tube, a configuration in which part of the arm is placed at a position that overlaps the tube in side view, and a configuration in which part of the arm is disposed inside with respect to the tube. Accordingly, since the arm is disposed outside with respect to the curved tube, the tube can be prevented from being interfered by the arm during deformation in curvature of the tube. Further, since the tube is biased toward the outside via the arm, the movement of the tube is positively restricted, thereby further decreasing the curvature change of the tube during the reciprocating motion of the carriage. Therefore, an effect on the carriage due to the deformation in curvature of the tube can be further reduced.

It is preferable that supporting members that support curvature of the tube at both ends of the tube are located at upper and lower positions.

Accordingly, the supporting members that support curvature of the tube at both ends of the tube are located at upper and lower positions. That is, the tube extends along a plane which is along the substantially vertical direction. In other words, the tube is positioned in a vertical plane. In the recording apparatus in which the tube curves along a plane which is along the substantially vertical direction (vertical direction), the curvature change of the tube during the reciprocating motion of the carriage tends to increase due to the effect of the gravity. However, in this aspect of the invention, the recording apparatus having the above configuration can also reduce an effect on the carriage due to the deformation in curvature of the tube.

It is preferable that a recess is formed in an area of the flexible member guiding section which is configured to oppose the connecting section.

There is a risk that an abnormal noise is generated if the connecting section collides with the flexible member guiding section. However, in this aspect of the invention, the recess is formed in an area of the flexible member guiding section which is configured to oppose the connecting section. This configuration can prevent an abnormal noise from being generated.

According to a second aspect of the invention, a recording apparatus includes a housing; a recording head that is disposed in the housing and is capable of recording by ejecting ink onto a recording medium; a carriage that is movable in a reciprocating manner with the recording head being mounted on the carriage; a substrate that is disposed outside of the carriage; a flexible cable that deforms in response to a movement of the carriage and through which signals are transmitted from the substrate to the recording head; a frame that is disposed in the housing; a flexible member guiding section that is fixed to the frame; an arm that is disposed on the flexible member guiding section, supports the cable, and is swingably movable in response to the movement of the carriage; and a connecting section that has a holding section which holds the cable and supports the cable in a manner movable relative to the arm.

The phrase "the connecting section that supports the cable in a manner movable relative to the arm" means a configuration in which the connecting section is fixed to the cable and is movable with the cable relative to the arm as well as a configuration in which the connecting section is not fixed to the cable and is movable relative to the cable and the arm.

Accordingly, the connecting section is movable relative to the arm in response to the movement of the carriage. Therefore, when the tube is deformed (deformed in curvature of the ink supply tube) in response to the reciprocating motion of the carriage, an excessive force is not applied to a portion of the cable which is held by the holding section, unlike in the case of a fixed configuration. As a result, the curvature can be smoothly deformed, thereby reducing an effect on the behavior of the carriage due to the deformation in curvature of the cable. Further, when the arm swings, an excessive force is not repeatedly applied to the same position or the same area of the cable. This may prevent abrasion or deterioration of the portion of the cable which is held by the holding section.

It is preferable that the connecting section is variable in orientation in response to the reciprocating motion of the carriage.

Accordingly, when the cable is deformed in curvature in response to the reciprocating motion of the carriage, the connecting section can move with respect to the arm and also change its orientation. As a result, the curvature can be further smoothly deformed, thereby further reducing an effect on the behavior of the carriage.

It is preferable that the arm is disposed outside with respect to the curved cable, and the recording apparatus further includes a biasing section that biases the arm toward the outside.

The phrase "the arm is disposed outside with respect to the curved cable" means a configuration in which an entire arm is disposed outside with respect to the cable, a configuration in which part of the arm is placed at a position that overlaps the cable in side view, and a configuration in which part of the arm is disposed inside with respect to the cable. Accordingly, since the arm is disposed outside with respect to the curved cable, the cable can be prevented from being interfered by the arm during deformation in curvature of the cable. Further, since the cable is biased toward the outside via the arm, the movement of the cable is positively restricted, thereby further decreasing the curvature change of the cable during the reciprocating motion of the carriage. Therefore, an effect on the carriage due to the deformation in curvature of the cable can be further reduced.

It is preferable that supporting members that support curvature of the cable at both ends of the cable are located at upper and lower positions.

Accordingly, the supporting members that support curvature of the cable at both ends of the cable are located at upper and lower positions. That is, the cable extends along a plane which is along the substantially vertical direction. In other words, the cable is positioned in a vertical plane. In the recording apparatus in which the cable curves along a plane which is along the substantially vertical direction (vertical direction), the curvature change of the cable during the reciprocating motion of the carriage tends to increase due to the effect of the gravity. However, in this aspect of the invention, the recording apparatus having the above configuration can also reduce an effect on the carriage due to the deformation in curvature of the cable.

It is preferable that a recess is formed in an area of the flexible member guiding section which is configured to oppose the connecting section.

There is a risk that an abnormal noise is generated if the connecting section collides with the flexible member guiding section. However, in this aspect of the invention, the recess is formed in an area of the flexible member guiding section which is configured to oppose the connecting section. This configuration can prevent an abnormal noise from being generated.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

FIGS. 1-13

Figure 1:
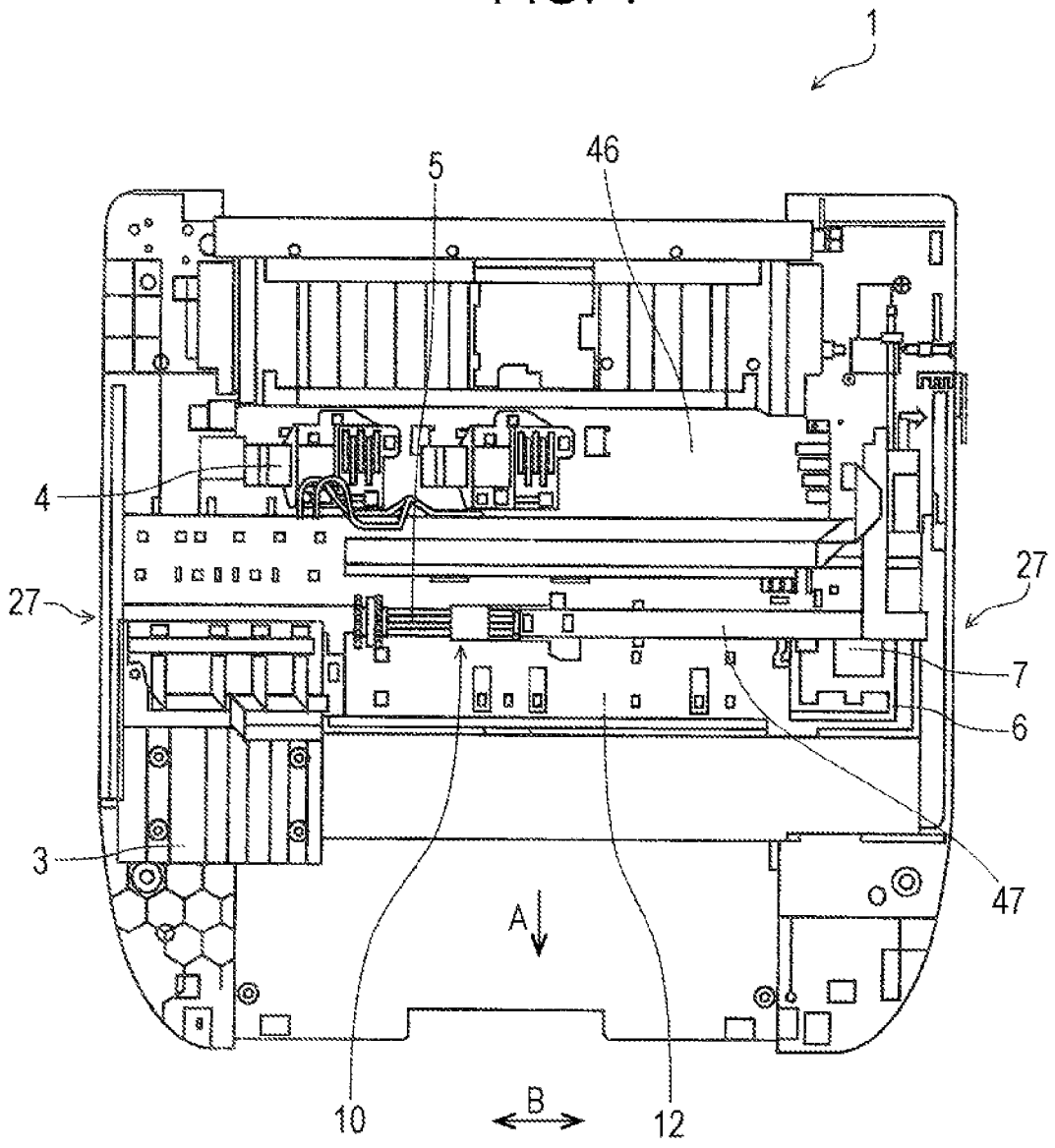
FIG. 1 is a schematic plan view of a recording apparatus according to an embodiment of the invention.
Figure 2:
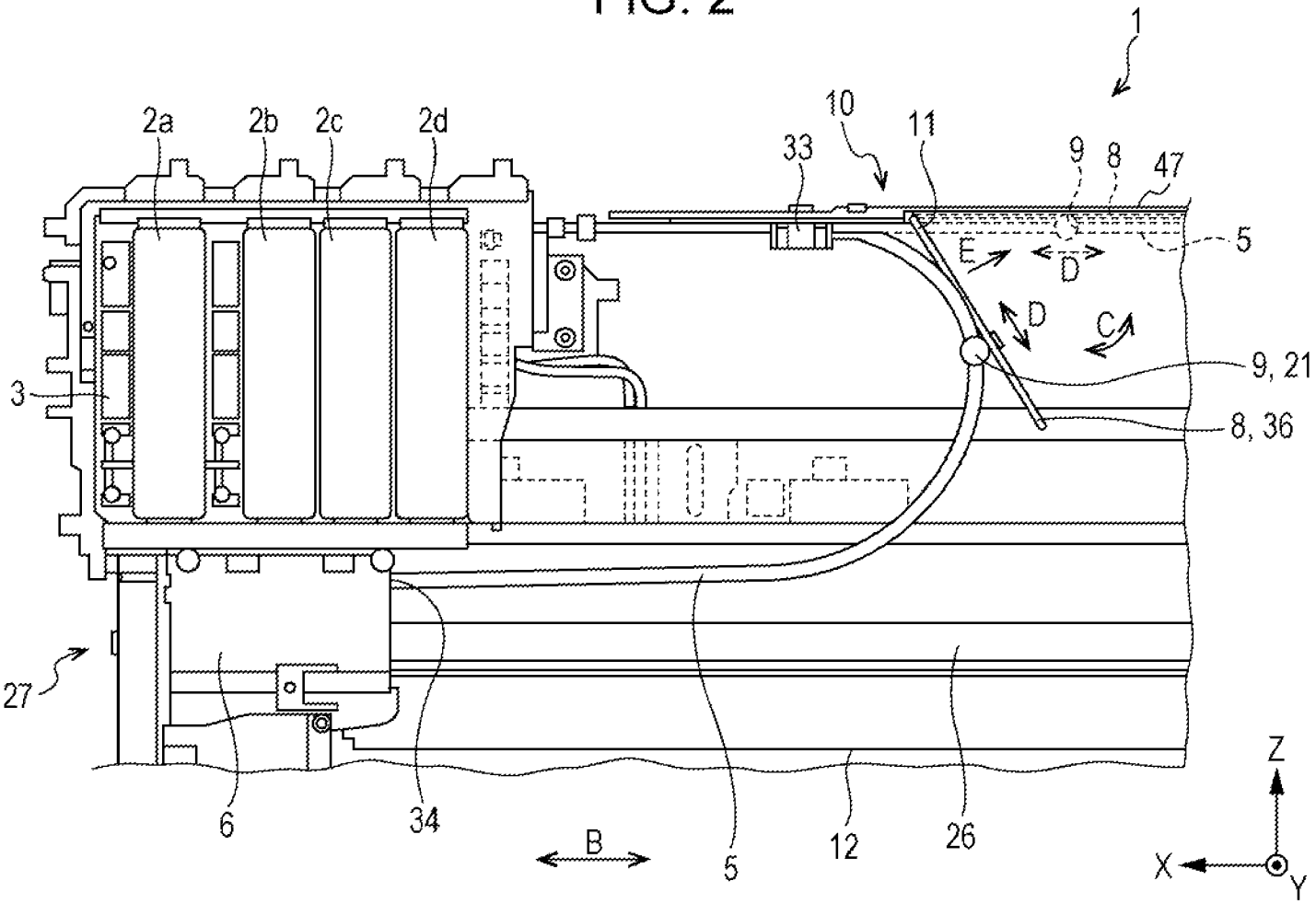
FIG. 2 is a schematic front view of the recording apparatus according to the embodiment.

A recording apparatus according to an embodiment of the invention will be described below in detail with reference to the accompanying drawings. First, an overview of a recording apparatus 1 according to a first embodiment will be described. FIG. 1 is a schematic plan view of the recording apparatus 1 according to this embodiment, and FIG. 2 is a schematic front view of the recording apparatus 1. In FIG. 2, the X direction is a direction along a scanning direction of a carriage 6 and the Z direction is a height direction of the recording apparatus 1.

The recording apparatus 1 according to this embodiment is an ink jet recording apparatus which includes a setting section 3 in which ink cartridges 2*a*-2*d* as an ink storing unit for storing ink are set and is configured such that ink can be supplied from the ink cartridges 2*a*-2*d* to a recording head 7 which is mounted on a carriage 6 through a tube 5 by driving an ink supply pump 4. The ink cartridges 2*a*-2*d* are disposed outside the carriage 6.

The recording head 7 which is mounted on the carriage 6 can perform printing by ejecting ink onto a recording medium which is transported in a transportation direction A. The carriage 6 is disposed in the housing of the recording apparatus 1 and is movable in a reciprocating manner in a direction B which is perpendicular to the transportation direction A.

The tube 5 is disposed in a curved state and allows ink to flow from the ink cartridges 2*a*-2*d* to the recording head 7 which is mounted on the carriage 6. The tube 5 is a flexible tube which can be deformed (deformed in curvature) in response to the reciprocating motion of the carriage 6. Further, the recording apparatus 1 according to this embodiment includes a tube support 10 which has an arm 36 that is capable of supporting the tube 5, a holding section 21 that holds the tube 5 and a connecting section 9 that allows the arm 36 to support the tube 5.

When the carriage 6 moves in a reciprocating manner, the arm 36 is swingably movable in a direction C about a swing shaft 11 which extends in a direction perpendicular to a plane formed by the curved tube 5 (in this embodiment, a direction along the transportation direction A). The connecting section 9 is configured to allow the arm 36 to swing in response to the reciprocating motion of the carriage 6. Specifically, the connecting section 9 is movable in a direction D with respect to the arm 36 in response to the reciprocating motion of the carriage 6.

Further, the recording apparatus 1 according to this embodiment includes a gap adjustment mechanism 27 so that a platen gap (PG) between a platen 12 which is a supporting surface for the recording medium and a nozzle surface of the recording head 7 on which nozzles that eject ink are disposed can be adjusted by adjusting a position of a main shaft 26. A configuration of components of the recording apparatus 1 will be described below in detail.

Tube Support, Arm and Connecting Section

Figure 3:
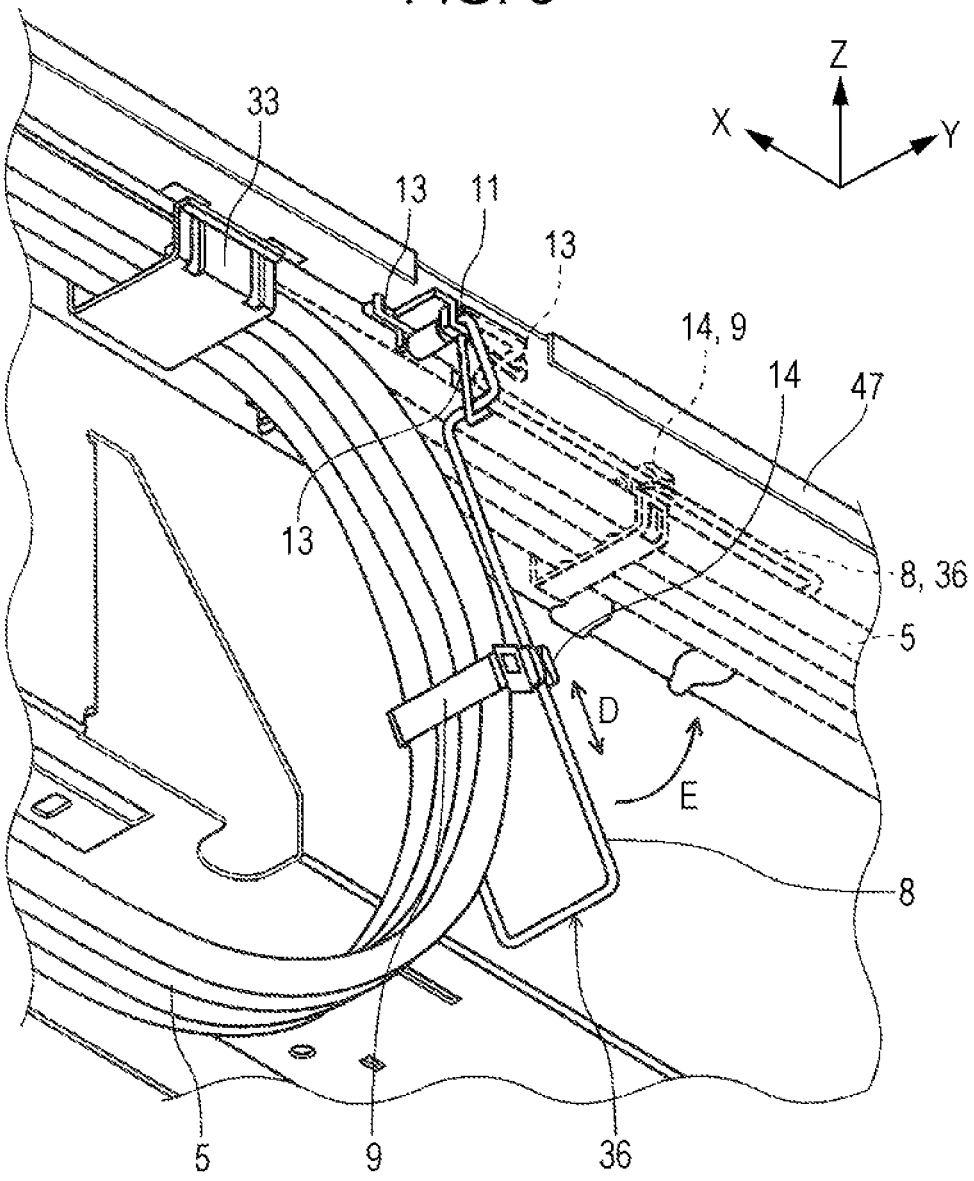
FIG. 3 is a schematic perspective view as seen from the lower side of a tube support according to the embodiment.
Figure 5:
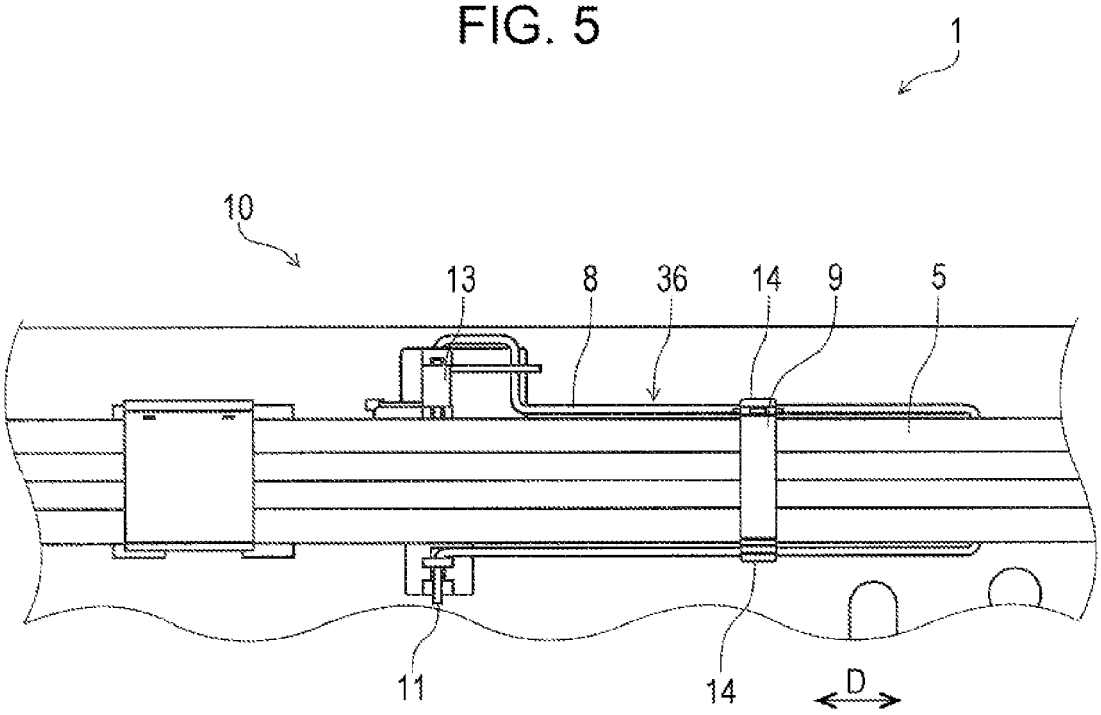
FIG. 5 is a schematic view as seen from the lower side of the tube support according to the embodiment.
Figure 6:
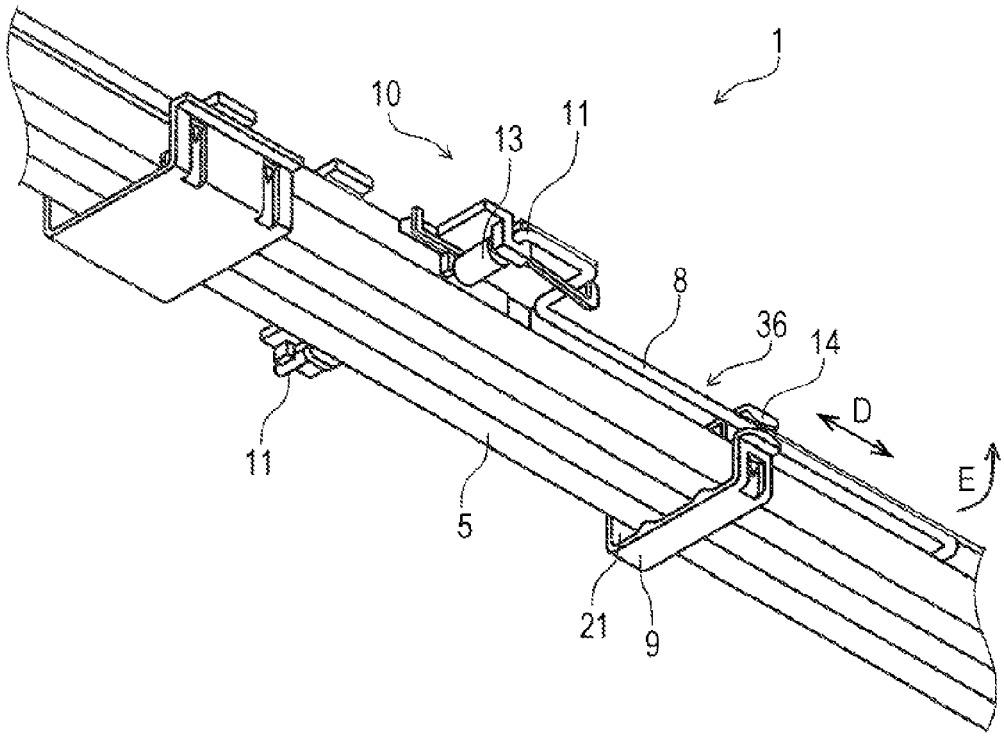
FIG. 6 is a schematic perspective view as seen from the obliquely lower side of the tube support according to the embodiment.
Figure 7:
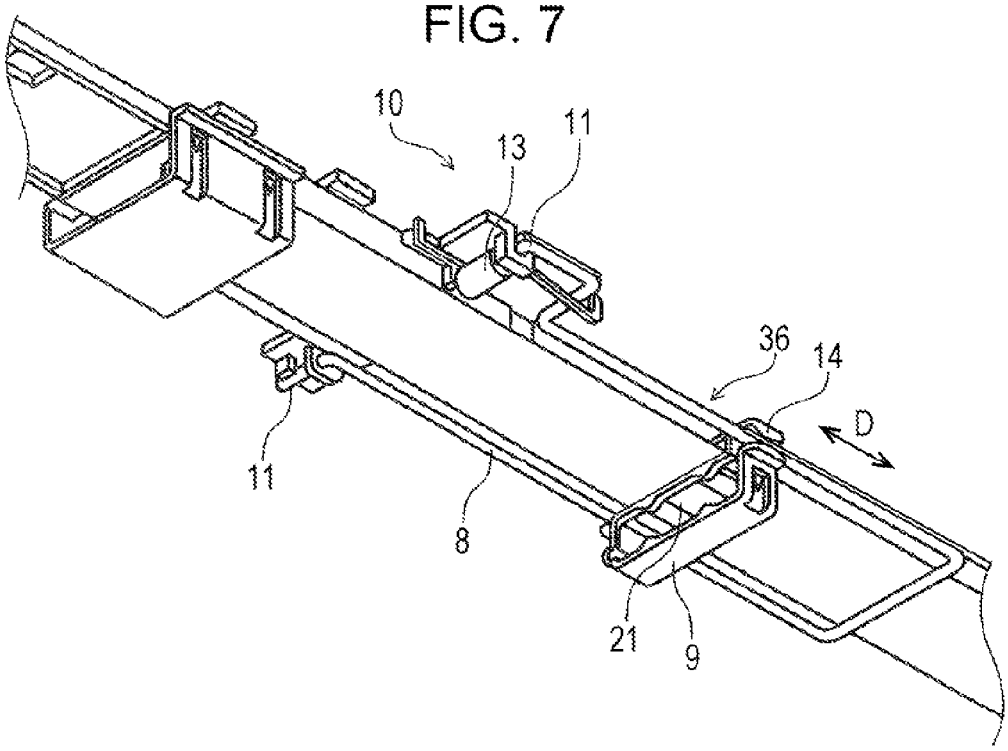
FIG. 7 is a schematic perspective view of FIG. 6 with the tube removed.

First, the tube support 10 according to this embodiment will be described below in detail with reference to FIGS. 3-7. FIG. 3 is a schematic perspective view as seen from the lower side of the tube support 10 of this embodiment, FIG. 4 is an enlarged view of an essential part of FIG. 2, FIG. 5 is a schematic view as seen from the lower side of the tube support 10 of this embodiment, FIG. 6 is a schematic view as seen from the obliquely lower side of the tube support 10 of this embodiment, and FIG. 7 is a schematic perspective view of FIG. 6 with the tube 5 removed.

The tube support 10 according to this embodiment is configured such that the arm 36 is swingably movable about the swing shaft 11. The arm 36 is a substantially U-shaped member which is formed by bending a round rod 8 into the shape shown in the figure. Although the arm 36 is described as the round rod 8, a square rod, an elongated plate or the like may also be used. The connecting section 9 includes a pair of mounting sections 14, 14 and is slidably mounted on the round rod 8 of the arm 36 via the mounting sections 14, 14. In this embodiment, the mounting sections 14, 14 are formed as a substantially U-shaped groove such that the round rod 8 of the arm 36 extend through the mounting sections 14, 14 which are formed as a substantially U-shaped groove. With this configuration, the connecting section 9 is swingably movable in the direction D in response to the swing of the arm 36.

The tube support 10 of the recording apparatus 1 according to this embodiment having the above described configuration allows the relative movement of the tube 5 and the arm 36 when the tube 5 is deformed in curvature while restricting the movement of the tube 5 so as to reduce the curvature change of the tube 5 during the reciprocating motion of the carriage 6. The connecting section 9 that holds the tube 5 by the holding section 21 slides in the longitudinal direction of the round rod 8 in the state that the mounting sections 14, 14 engage with a pair of round rods 8 of the arm 36. With this configuration, the curvature of the tube 5 can be smoothly deformed while reducing a load applied to the tube 5 during the reciprocating motion of the carriage 6, thereby reducing an effect on the behavior of the carriage 6.

Figure 4:
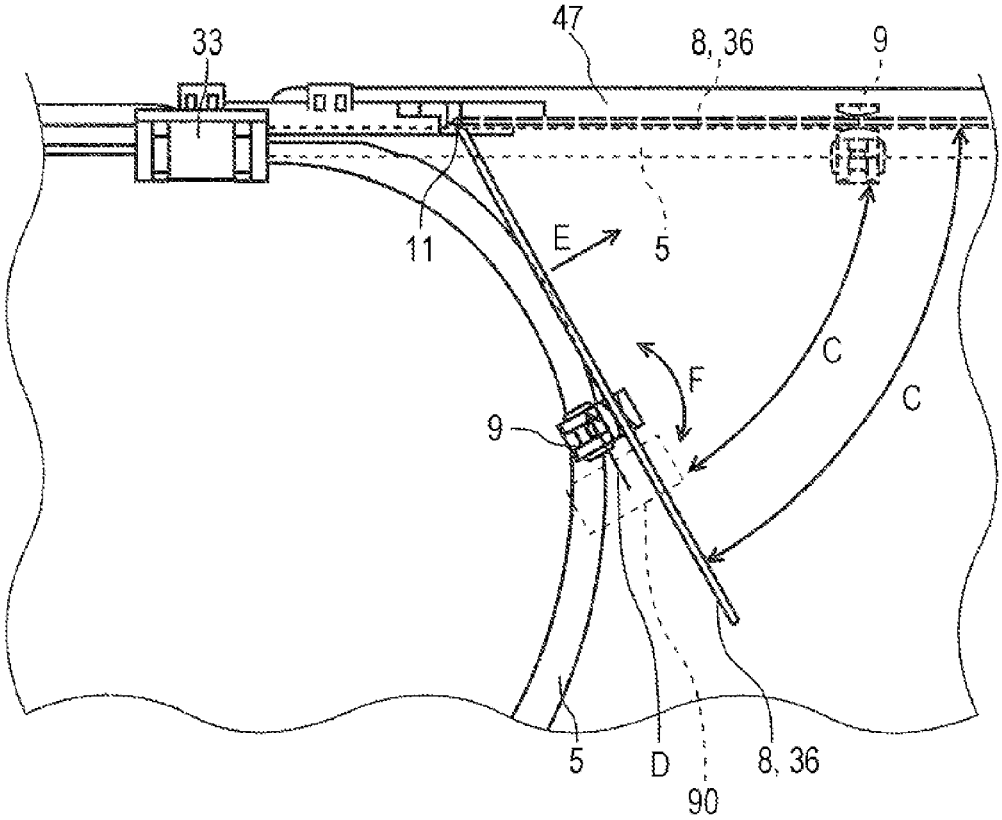
FIG. 4 is an enlarged view of an essential part of FIG. 2.

As shown in FIGS. 2-4, in the tube support 10 according to this embodiment, the arm 36 is disposed outside with respect to the curved tube 5. Further, a torsion spring 13 (FIG. 3) is disposed as a biasing section that biases the arm 36 toward the outside in a direction E. Accordingly, when the tube 5 is deformed in curvature, the tube 5 can be prevented from being interfered by the arm 36, while the movement of the tube 5 is positively restricted, thereby reducing the curvature change of the tube 5 during the reciprocating motion of the carriage 6.

As shown in FIGS. 1-4, a main frame 46 is disposed in the housing of the recording apparatus 1 so as to be combined with a base frame, which is not shown in the figure, which forms the base of the recording apparatus, and a flexible member guiding section 47 is fixed to the main frame 46. A supporting section 33 that supports the tube 5, which is described later, is fixed to the flexible member guiding section 47. As shown in FIG. 2, the tube 5 according to this embodiment curves along a plane which is formed by the reciprocating direction B of the carriage 6 and the vertical direction (vertical plane). In other words, the plane formed by the curved tube 5 is a plane formed by the reciprocating direction B of the carriage 6 and the vertical direction, and supporting members 33, 34 that support the curvature of the tube 5 at both ends of the tube 5 are located at the upper and lower positions. That is, the tube 5 extends along a plane which is along the substantially vertical direction. Further, since the supporting section 33 is located at the center in the reciprocating direction B of the carriage 6, there is no risk of the tube 5 being overloaded or broken by the movement of the carriage 6.

In the recording apparatus 1 having the above described configuration, the curvature change of the tube 5 during the reciprocating motion of the carriage 6 tends to increase due to the effect of the gravity. However, in the recording apparatus 1 according to this embodiment, the tube support 10 having the above described configuration can reduce an effect on the carriage 6 due to the deformation in curvature of the tube 5. Further, since the tube 5 is configured to be movable only along a plane which is along the substantially vertical direction by the tube support 10, the recording apparatus 1 according to this embodiment is configured to restrict the movement of the tube 5 in the transportation direction A of the recording medium while restricting the movement of the tube 5 in the vertical direction.

Connecting Section

Figure 8:
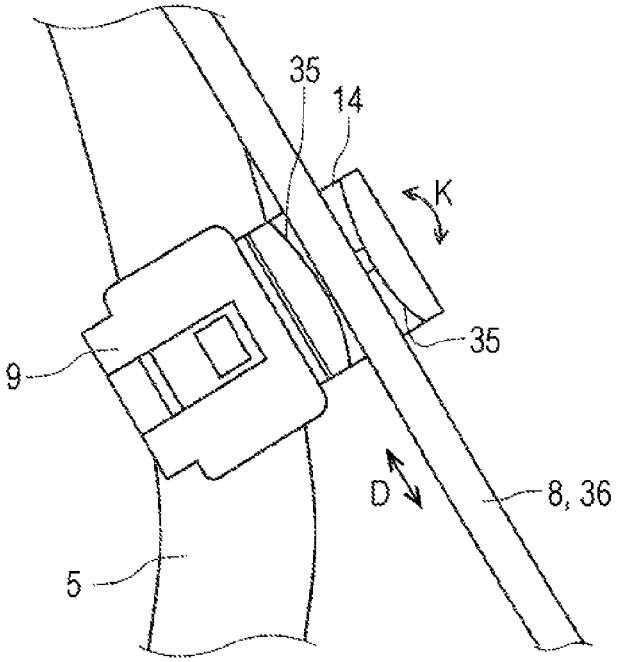
FIG. 8 is an enlarged view of a connecting section according to the embodiment as seen from the front side of the recording apparatus.
Figure 9:
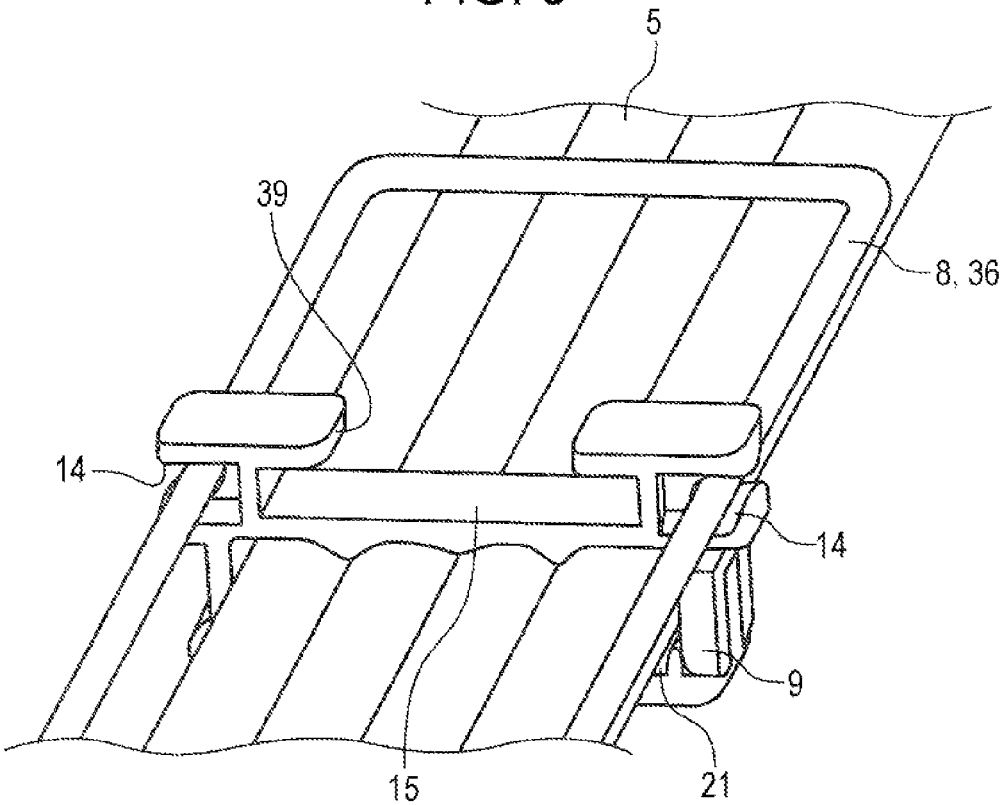
FIG. 9 is a perspective view as seen from the obliquely upper side of the connecting section according to the embodiment.
Figure 10:
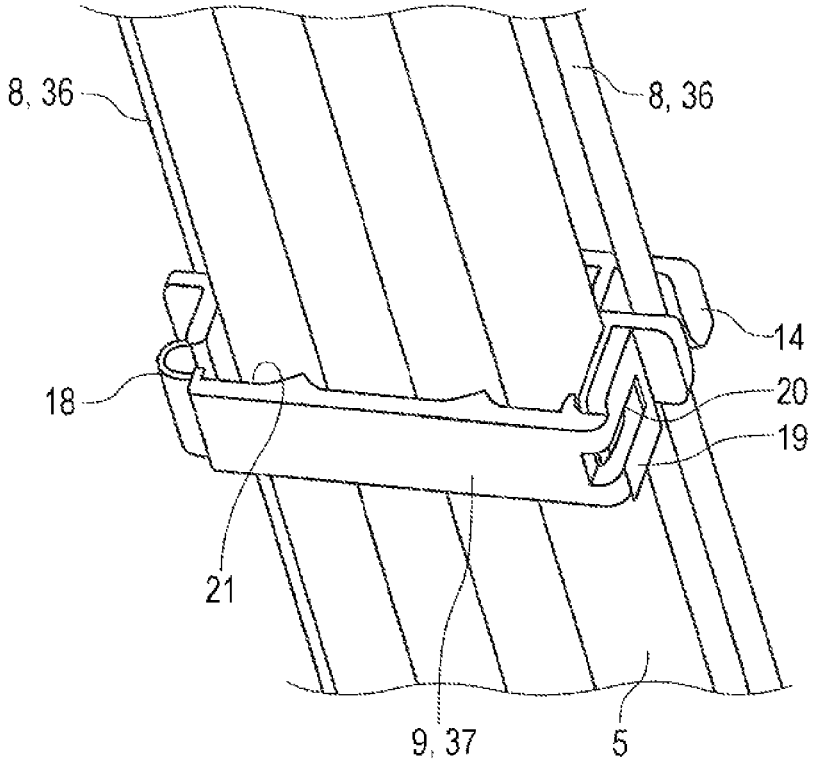
FIG. 10 is a perspective view as seen from the obliquely lower side of the connecting section according to the embodiment.
Figure 11:
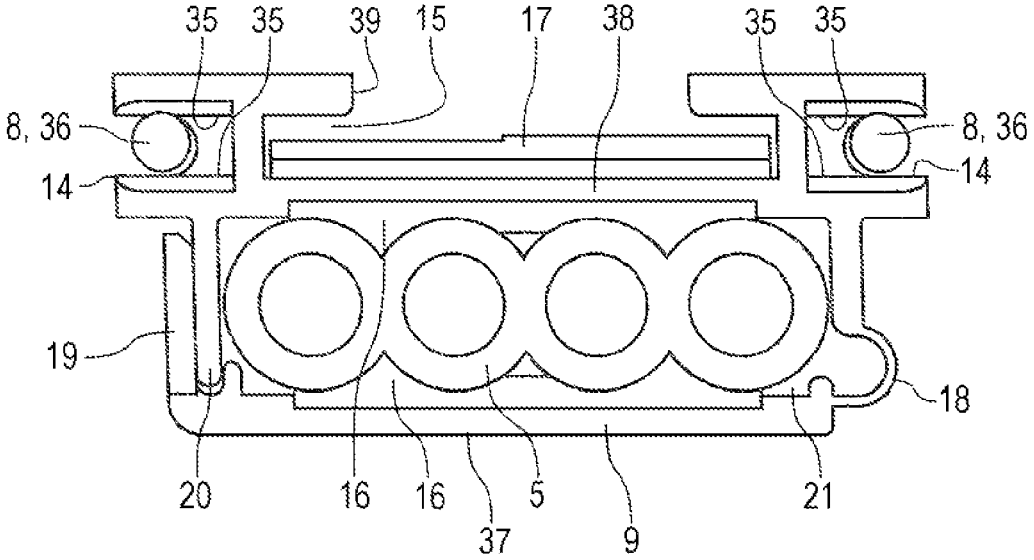
FIG. 11 is a side view of the connecting section according to the embodiment, part of which is shown in section.
Figure 12:
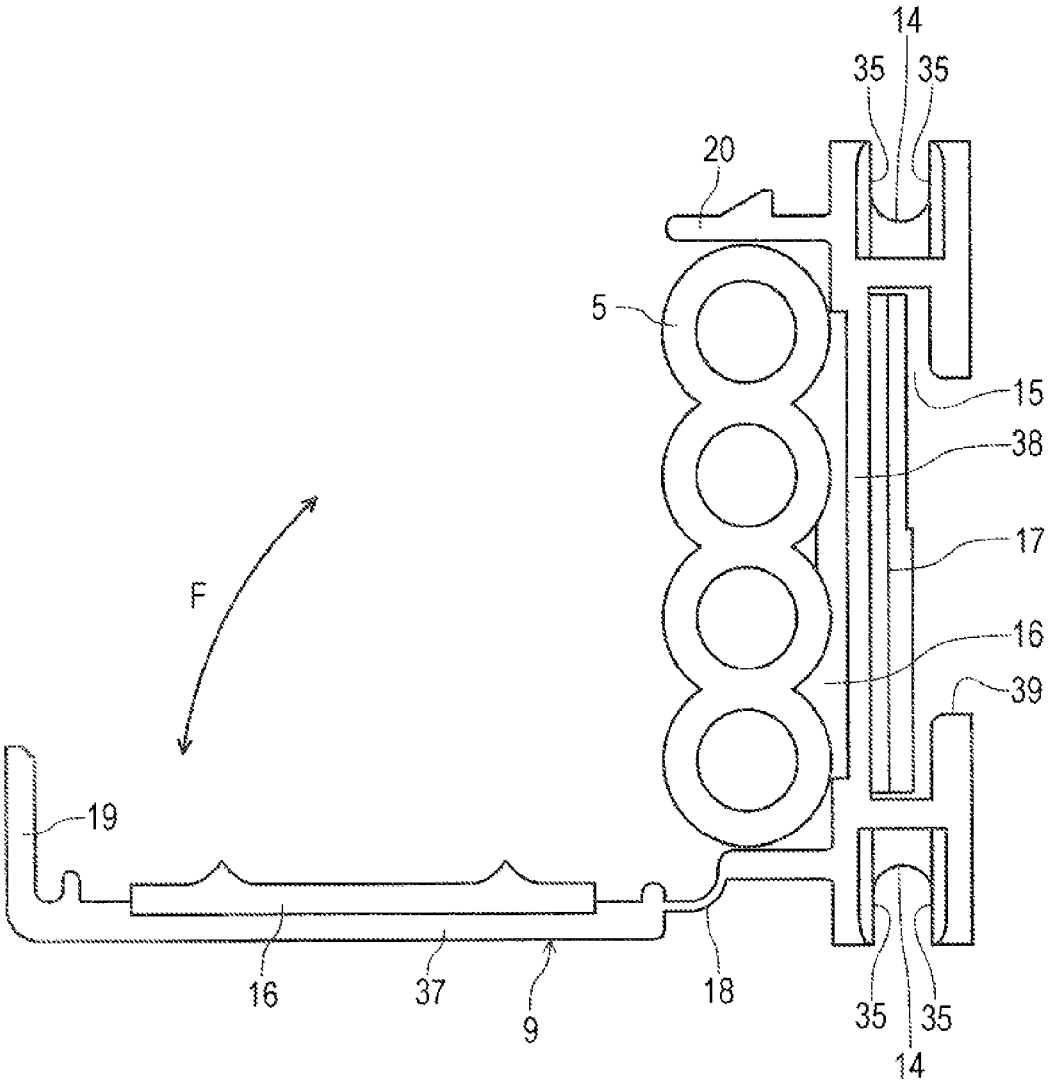
FIG. 12 is a side view which shows assembling of the tube to the connecting section according to the embodiment, part of which is shown in section.
Figure 13:
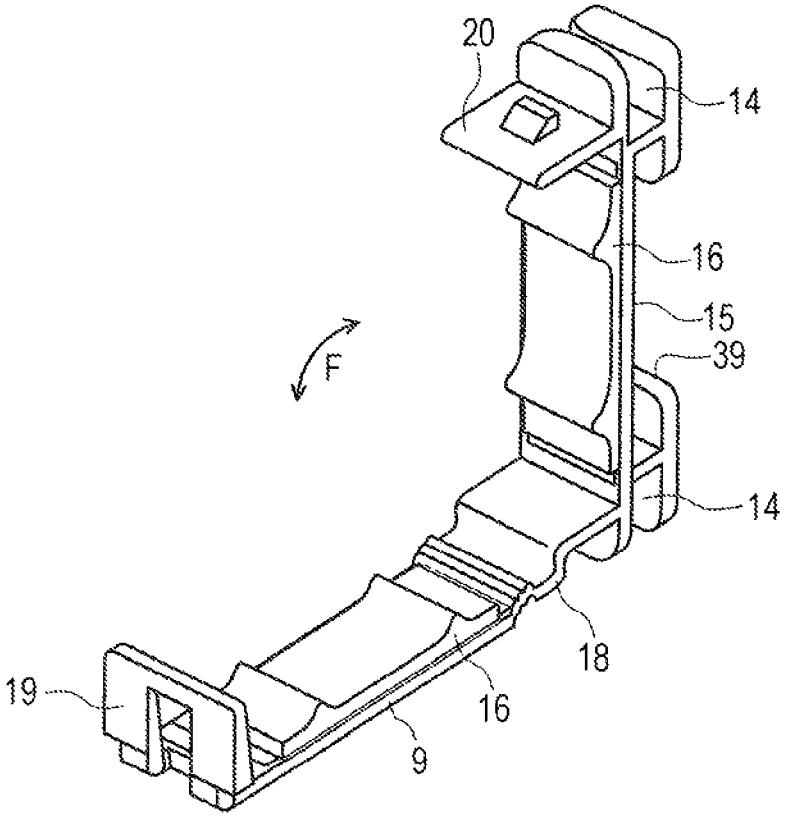
FIG. 13 is a schematic perspective view which shows that the connecting section according to the embodiment is removed from the recording apparatus.

Next, the connecting section 9 according to this embodiment will be described in detail. FIG. 8 is an enlarged view of the connecting section 9 according to this embodiment as seen from the front side of the recording apparatus, FIG. 9 is a perspective view as seen from the obliquely upper side of the connecting section 9 according to this embodiment, FIG. 10 is a perspective view as seen from the obliquely lower side of the connecting section 9 according to this embodiment, and FIG. 11 is a side view of the connecting section 9 according to this embodiment, part of which is shown in section. FIG. 12 is a side view which shows assembling of the tube to the connecting section 9 according to this embodiment, part of which is shown in section. FIG. 13 is a schematic perspective view which shows that the connecting section 9 according to this embodiment is removed from the recording apparatus 1.

As shown in FIG. 8, the connecting section 9 according to this embodiment is variable in orientation in response to the reciprocating motion of the carriage 6. Specifically, the above variable configuration is achieved by providing convex surfaces 35, 35 on the opposing inner surfaces of the mounting sections 14, 14 which are formed as a U-shaped groove. The convex surfaces 35, 35 are formed to allow the connecting section 9 to pivot, in other words, swingingly move in a direction K as shown in FIG. 8, thereby changing the orientation of the connecting section 9 with respect to the arm 36. The above variable configuration is not limited to the configuration using the convex surfaces 35, 35.

According to the above variable configuration, when the tube 5 is deformed in curvature in response to the reciprocating motion of the carriage 6, the connecting section 9 moves with respect to the arm 36 in the direction D and also rotates in the direction K to change its orientation. Accordingly, the curvature can be further smoothly deformed, thereby further reducing an effect on the behavior of the carriage 6.

As shown in FIGS. 9, 11, 12 and 13, the connecting section 9 according to this embodiment includes the mounting sections 14, 14 through which the arm 36 extends, the holding section 21 for the tube 5, and a holding section 15 through which a flexible flat cable (FFC) 17 which is an electric signal line extends. In this embodiment, the tube 5 is composed of four tubes which correspond to four ink colors. The four tubes are connected to each other into an integrated strip-shaped tube 5. Further, the recording apparatus 1 according to this embodiment includes a substrate, which is not shown in the figure, which is disposed outside the carriage 6, and the FFC 17 is a flexible cable that deforms in response to the movement of the carriage 6 and transmits signals from the substrate to the recording head 7. The arm 36 and the connecting section 9 of the recording apparatus 1 according to this embodiment support the FFC 17 as well as the tube 5. Accordingly, the arm 36 and the connecting section 9 serve for the FFC 17 in the same way as for the tube 5.

The holding section 21 for the tube 5 includes a pair of contact sections 16, 16 which comes into contact with the tube 5. The connecting section 9 is configured to open and close the holding section 21 by rotating a cover 37 in a direction F about a deformable section 18. That is, the connecting section 9 can be mounted on the tube 5 by attaching the base section 38 on the tube 5 with the cover 37 being opened as shown in FIG. 12, then closing the cover 37. In FIGS. 11-13, reference number 19 denotes an engaging section (having an engaging hole) on the cover 37, while reference number 20 denotes an engaging section (having an engaging projection) on the base section 38. When both engaging sections 19, 20 are engaged with each other, the cover 37 is in the closed state.

A portion of the connecting section 9 according to this embodiment which includes the contact sections 16, 16 which come into contact with the tube 5, the mounting sections 14, 14, the base section 38 and the cover 37 is two-color molded by two different materials. Specifically, the contact sections 16, 16 which come into contact with the tube 5 are made of elastmer, and the remaining is made of polypropylene. As a matter of course, other combinations of materials may also be used. The connecting section 9 having the above configuration can firmly hold the tube 5 without damaging the tube 5 and easily move relative to the arm 36 while achieving a robust configuration. It should be noted that other configurations may also be used.

In this embodiment, the connecting section 9 is fixed to the tube 5 and is movable with the tube 5 relative to the arm 36. Accordingly, it is preferable in that the movement of the tube 5 can be restricted while the tube 5 is supported by the arm 36 at a target position. The "target position" means, as described above, a position which is preferable to achieve a smooth deformation in curvature of the tube 5 in consideration of the weight balance and the like when the tube 5 is supported by the arm 36 and the connecting section 9. It should be noted that the configuration is not limited to the above described configuration, and a configuration in which the connecting section 9 is not fixed to the tube 5 and the tube 5 is movable relative to the connecting section 9 is also possible.

Holding Section of FFC

As shown in FIGS. 9, 11 and 13, in the connecting section 9 according to this embodiment, the holding section 15 for the FFC 17 has a wide opening 39 so that the FFC 17 can be inserted into the holding section 15 via the opening 39. Accordingly, the FFC 17 can be inserted into the holding section 15 at any part of the FFC, not at the longitudinal end of the FFC, which allows the FFC to be easily assembled. Further, it is also possible to reduce the risk of damaging the terminal at the end of the FFC 17 during assembling operation.

Second Embodiment

Next, the configuration of the connecting section 9 according to a second embodiment will be described below with reference to FIGS. 14 and 15. The connecting section 9 according to this embodiment includes thin walled portions 22 at each end of the base section 38. The thin walled portions 22 are configured to be easily deformed since the thin walled portions 22 have a thickness smaller than that of the remaining portion. In the following, how the FFC 17 is inserted into the holding section 15 of the connecting section 9 will be described.

Figure 14:
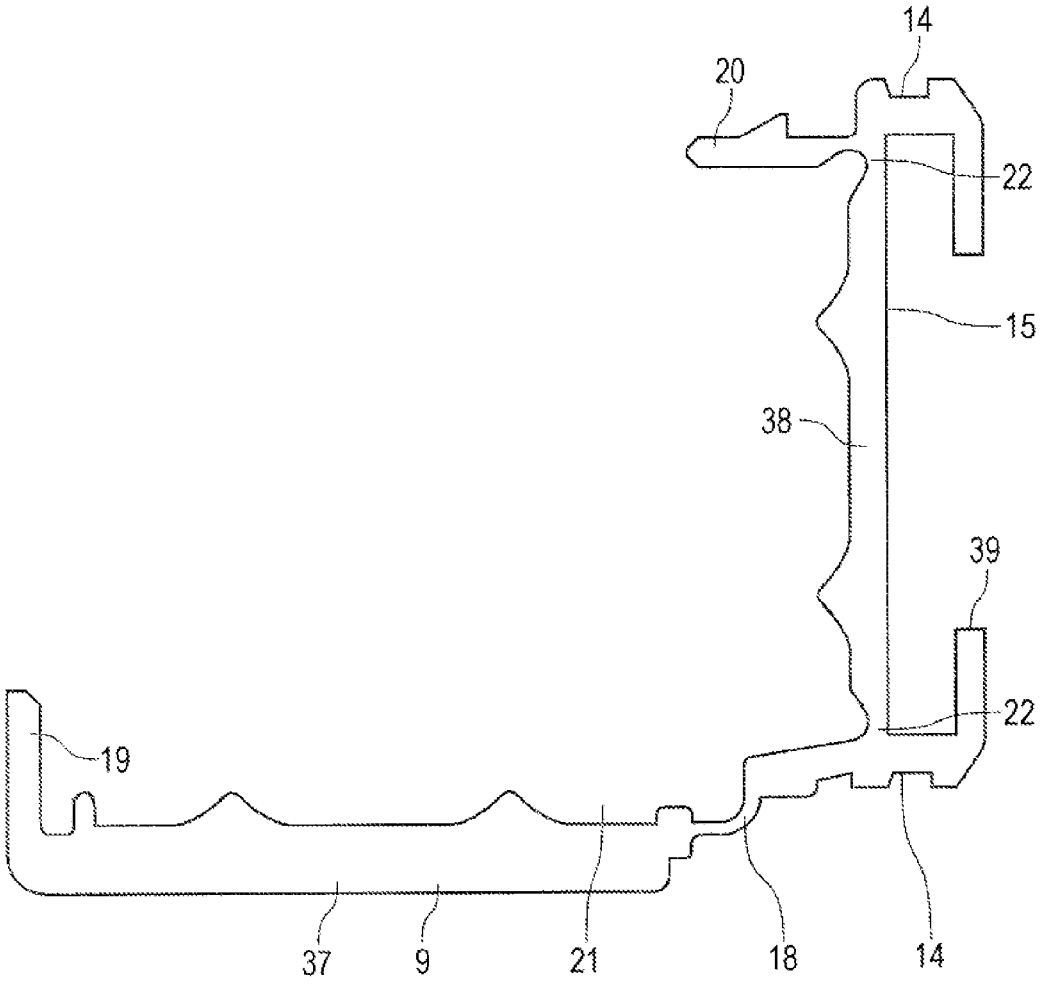
FIG. 14 is a side view of the connecting section for explaining an insertion operation of an FFC into the connecting section according to another embodiment of the invention.
Figure 15:
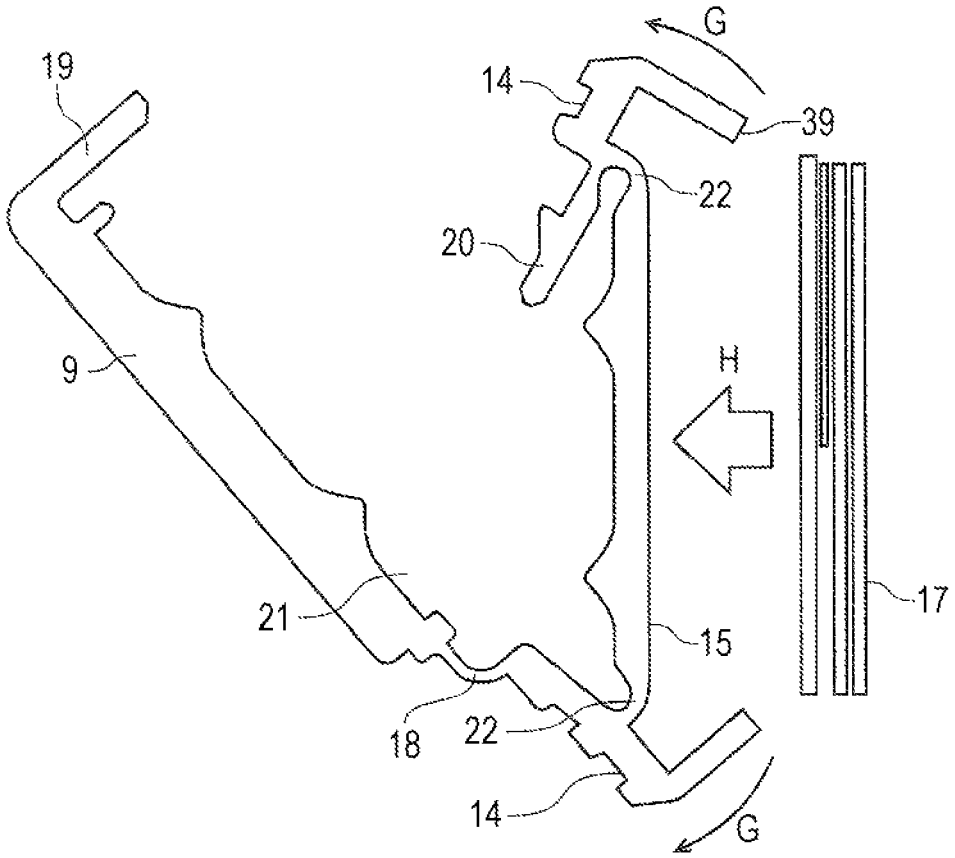
FIG. 15 is a schematic view of the connecting section for explaining an insertion operation of the FFC into the connecting section according to another embodiment of the invention.

FIG. 14 shows the connecting section 9 before the FFC 17 is inserted into the holding section 15 with the supporting section 21 for the tube 5 being opened. FIG. 15 shows the connecting section 9 when the FFC 17 is being inserted. During insertion of the FFC 17, as shown in FIG. 15, both ends of the connecting section 9 according to this embodiment are deformed in a direction G about the respective thin walled portions 22 on the base section 38. The opening 39 is thus widened, and then, the FFC 17 can be easily inserted in a direction H. With this configuration, the opening 39 can be smaller in size compared with the opening 39 which does not have the thin walled portion 22. Accordingly, the FFC 17 can remain stable in the inserted state. As a matter of course, the thin walled portion 22 can be also disposed on the base section 38 of the connecting section 9 in the above first embodiment.

Further, the second embodiment differs from the first embodiment in that the U-shaped groove of the mounting section 14 is a thin groove. An arm 36 which is configured to correspond to the thin groove is provided (not shown in the figure). Moreover, the second embodiment also differs from the first embodiment in that the holding section 21 is not two-color molded. This configuration is used when the connecting section 9 is not fixed to the tube 5 at a specific position.

Third Embodiment

Figure 21:
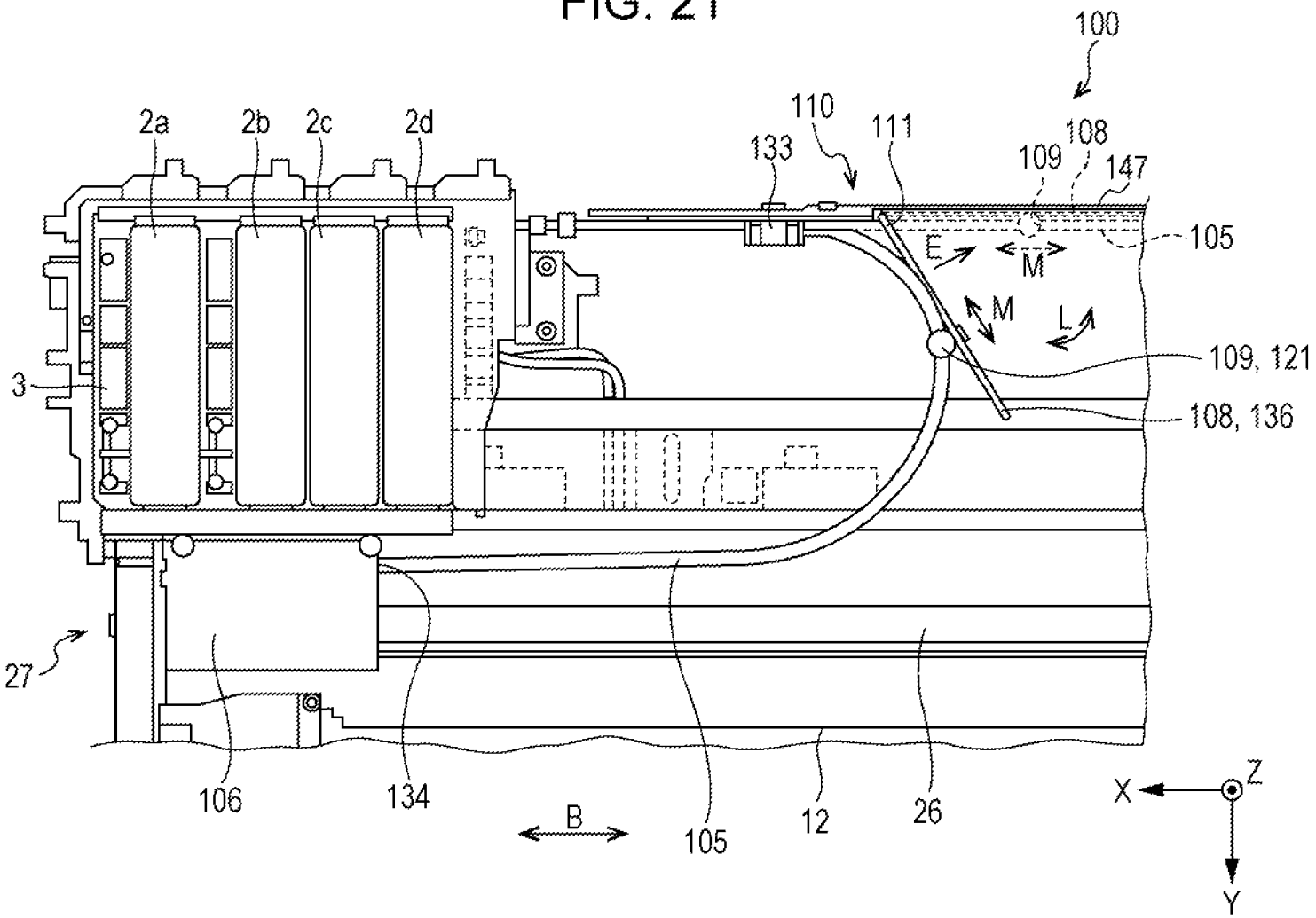
FIG. 21 is a schematic top view of the recording apparatus according to the embodiment.
Figure 22:
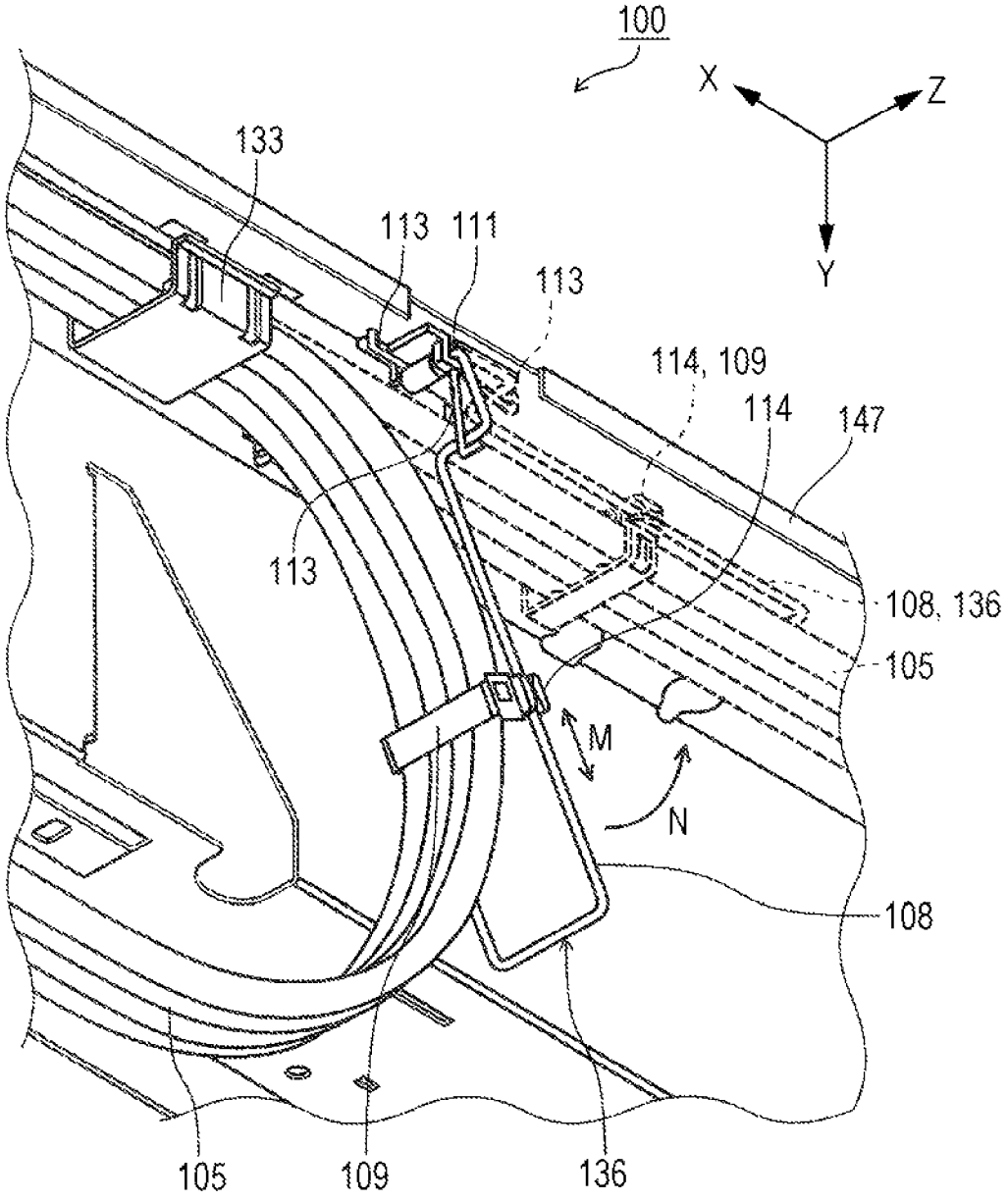
FIG. 22 is a schematic perspective view as seen from the side of the tube support according to another embodiment of the invention.

Next, a tube support 110 according to a third embodiment will be described below with reference to FIGS. 21 and 22. FIG. 21 is a schematic top view of a recording apparatus 100 according to this embodiment, and FIG. 22 is a perspective view as seen from the side of the tube support 110. The description of the same components as those of the first embodiment will be omitted.

A flexible member guiding section 147 is disposed in the housing of the recording apparatus 100. A supporting section 133 that supports a tube 105, which is described later, is fixed to the flexible member guiding section 147. Further, the recording apparatus 100 according to this embodiment includes the tube support 110 which has an arm 136 that is capable of supporting the tube 105, a holding section 121 that holds the tube 105 and a connecting section 109 that allows the arm 136 to support the tube 105.

When a carriage 106 moves in a reciprocating manner, the arm 136 is swingably movable in a direction L. The connecting section 109 is configured to allow the arm 136 to swing in response to the reciprocating motion of the carriage 106. Specifically, the connecting section 109 is movable in a direction M with respect to the arm 136 in response to the reciprocating motion of the carriage 106.

The tube support 110 according to this embodiment is configured such that the arm 136 is swingably movable about the swing shaft 111. The arm 136 is a substantially U-shaped member which is formed by bending a round rod 108 into the shape shown in the figure. Although the arm 136 is described as the round rod 8, a square rod, an elongated plate or the like may also be used. The connecting section 109 includes a pair of mounting sections 114, 114 and is slidably mounted on the round rod 108 of the arm 136 via the mounting sections 114, 114. In this embodiment, the mounting sections 114, 114 are formed as a substantially U-shaped groove such that the round rod 118 of the arm 136 extends through the mounting sections 114, 114 which are formed as a substantially U-shaped groove. With this configuration, the connecting section 109 is swingably movable in the direction M in response to the swing of the arm 136.

The tube support 110 of the recording apparatus 1 according to this embodiment having the above described configuration allows the relative movement of the tube 105 and the arm 136 during deformation in curvature of the tube 105 while restricting the movement of the tube 105, thereby reducing the curvature change of the tube 105 during the reciprocating motion of the carriage 106. The connecting section 109 that holds the tube 105 by the holding section 121 slides in the longitudinal direction of the round rod 108 in the state that the mounting sections 114, 114 engage with a pair of round rods 108 of the arm 136. With this configuration, the curvature of the tube 105 can be smoothly deformed while reducing a load applied to the tube 105 during the reciprocating motion of the carriage 106, thereby reducing an effect on the behavior of the carriage 106.

In the tube support 110 according to this embodiment, the arm 136 is disposed outside with respect to the curved tube 105. Further, a torsion spring 113 is disposed as a biasing section that biases the arm 136 toward the outside in a direction N. Accordingly, when the tube 105 is deformed in curvature, the tube 105 can be prevented from being interfered by the arm 136, while the movement of the tube 105 is positively restricted, thereby reducing the curvature change of the tube 105 during the reciprocating motion of the carriage 106.

The tube 105 in FIG. 21 differs from the tube 5 in the first embodiment in that the tube 105 curves along a plane formed by the transportation direction A and the horizontal direction (transverse plane). In other words, supporting members 133, 134 that support the tube 105 at both ends of the tube 105 are located at the upstream and downstream positions in the transportation direction A. That is, the tube 105 extends along a plane which is along the substantially horizontal direction. Further, since the supporting section 133 is located at the center in the reciprocating direction of the carriage 106, there is no risk of the tube 105 being overloaded or broken by the movement of the carriage 106.

In the recording apparatus 1 having the above described configuration, the curvature change of the tube 105 during the reciprocating motion of the carriage 106 tends to increase due to the effect of the gravity. However, in the recording apparatus 1 according to this embodiment, the tube support 110 having the above described configuration can reduce an effect on the carriage 106 due to the deformation in curvature of the tube 105. Further, since the tube 105 is configured to be movable only along a plane which is along the substantially horizontal direction by the tube support 110, the recording apparatus 1 according to this embodiment is configured to restrict the movement of the tube 105 in the horizontal direction while restricting the movement of the tube 105 in the vertical direction.

In the positional relationship between the supporting sections 133, 134 at both ends of the tube 105, the supporting section 134 may be located upstream to the supporting section 133 in the transportation direction, or vice versa. That is, the tube 105 may be positioned with respect to the carriage 106 so as to extend from the upstream to downstream in the transportation direction, or alternatively, the tube 105 may be positioned with respect to the carriage 106 so as to extend from the downstream to upstream in the transportation direction.

Further, the FFC 17 which is a flexible cable that deforms following the movement of the carriage 106 and transmits signals from the substrate to the recording head 7 may be held in addition to the tube 105, or alternatively, only the FFC 17 may be held.

Platen Gap Adjustment Mechanism

Figure 16:
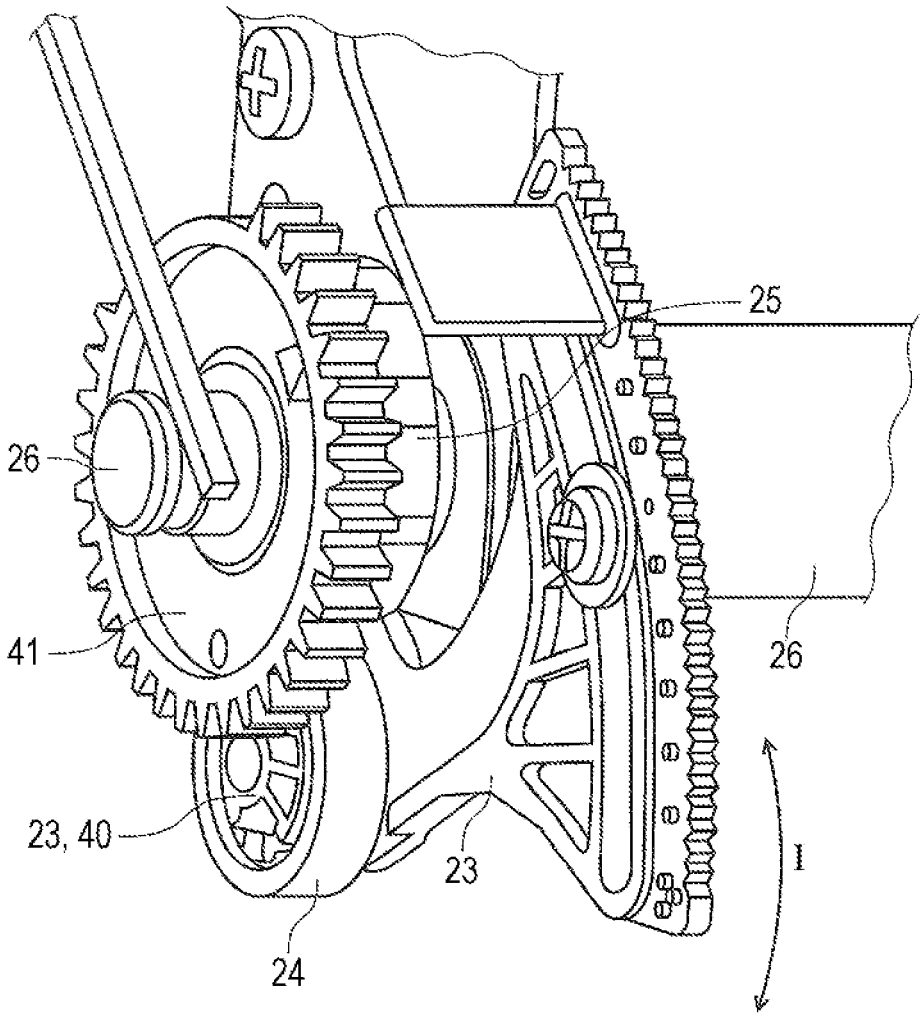
FIG. 16 is a schematic perspective view of a platen gap adjustment mechanism of the recording apparatus according to an embodiment of the invention.

Next, the platen gap adjustment mechanism of the recording apparatus according to this embodiment will be described below in detail. FIG. 16 is a schematic perspective view of the platen gap adjustment mechanism of the recording apparatus according to this embodiment, FIG. 17 is a sectional view of the platen gap adjustment mechanism of the recording apparatus according to this embodiment, and FIG. 18 is a schematic side view of the platen gap adjustment mechanism of the recording apparatus according to this embodiment.

The platen gap adjustment mechanism 27 according to this embodiment is a mechanism that automatically adjusts the platen gap PG depending on the type of the recording medium (difference in thickness) or different recording modes. The platen gap adjustment mechanism 27 includes a PG adjustment cam 23 that sets the basic platen gap PG by adjusting the rotation amount in a direction I (FIGS. 16 and 18), a rotation section (bush) 24 in a cylindrical form which is disposed so as to be in contact with the outer periphery of an eccentric cam 40 of the PG adjustment cam 23, and an APG cam (eccentric cam) 25 which is mounted on each end of the main shaft 26 so as to be in contact with the rotation section (bush) 24. The PG adjustment cam 23 and the rotation section 24 are also disposed at positions which correspond to each end of the main shaft 26.

Figure 17:
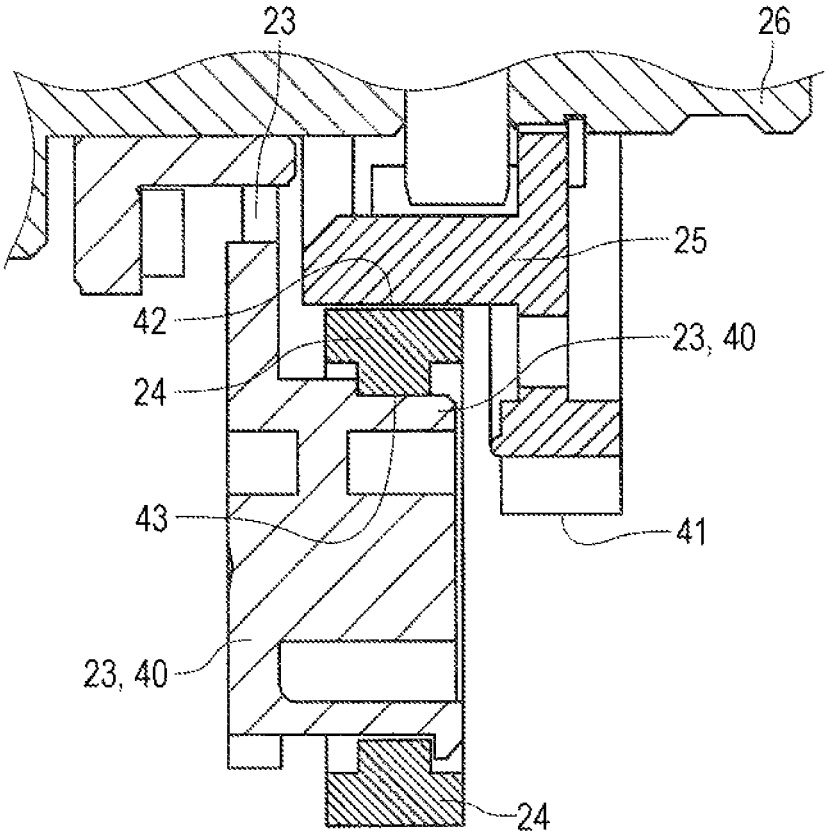
FIG. 17 is a sectional view of the platen gap adjustment mechanism of the recording apparatus according to the embodiment.
Figure 18:
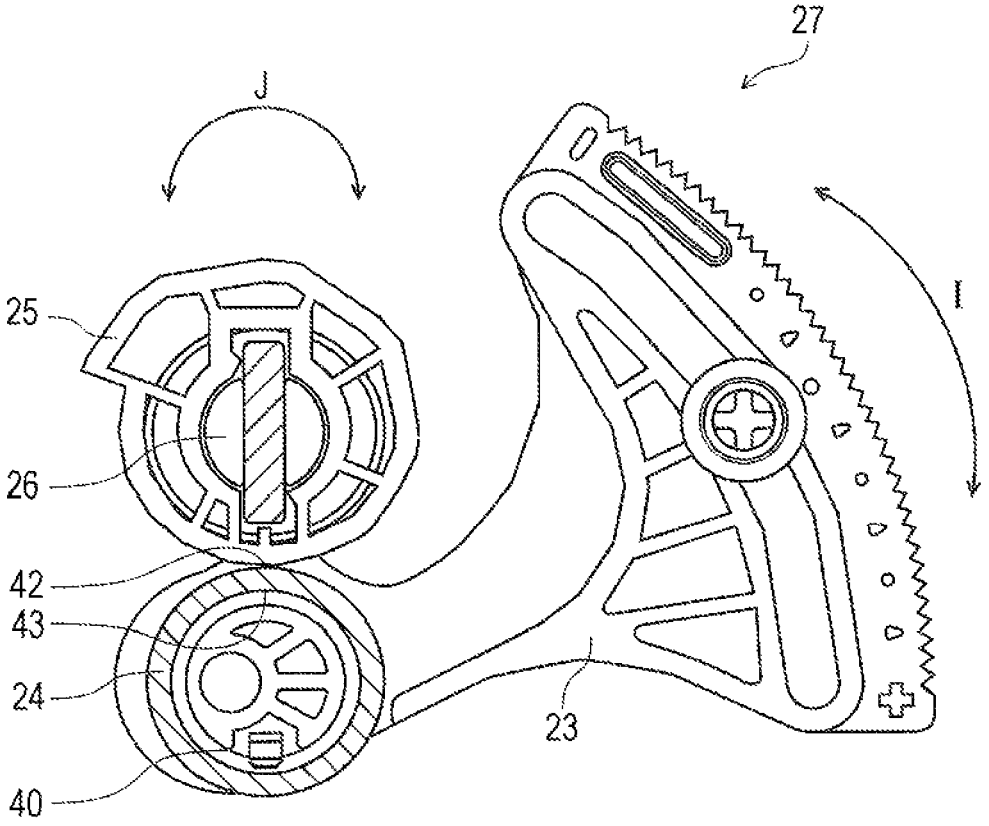
FIG. 18 is a schematic side view of the platen gap adjustment mechanism of the recording apparatus according to the embodiment.

As shown in FIGS. 16 and 17, a gear 41 is disposed on each end of the main shaft 26. The gear 41, the main shaft 26 and the APG cam 15 integrally rotate. As a rotational force is transmitted from a power source, which is not shown in the figure, to the gear 41, the main shaft 26 rotates integrally with the APG cam 25. The position of the main shaft 26 can be changed in a PG adjustment direction (in this embodiment, the height direction) by rotating the APG cam 25 in a direction J (FIG. 18) so that the platen gap PG can be changed by rotating the APG cam 25. That is, the platen gap PG can be changed depending on the thickness of the recording medium and the like by rotating the APG cam 25.

The platen gap adjustment mechanism 27 according to this embodiment is configured such that the rotation section 24 co-rotates with rotation of the APG cam 25 and the rotation section 24 slides with respect to the PG adjustment cam 23. In this embodiment, this co-rotation configuration is achieved by adjusting a frictional force. Specifically, the configuration is achieved by setting the contact length of the contact section 42 in which the APG cam 25 is in contact with the outer periphery of the rotation section 24 in the longitudinal direction of the main shaft 26 to be smaller than the contact length of the contact section 43 in which the eccentric cam 40 of the PG adjustment cam 23 is in contact with the inner periphery of the rotation section 24 in the longitudinal direction of the main shaft 26, as shown in FIG. 17. As the contact length becomes longer, the frictional force becomes larger, thereby enabling the above co-rotation configuration. Further, the co-rotation configuration may be achieved by adjusting the frictional force by materials of the components, interposing a frictional member (elastic member such as a rubber) between the APG cam 25 and the rotation section 24, or using an involute configuration at the contact section between the APG cam 25 and the rotation section 24.

The co-rotation configuration can reduce the local abrasion of the cam profile of the APG cam 25. For example, it is possible to reduce uneven abrasion of the APG cam 25, which occurs when the APG cam 25 is not often rotated at a position other than the specific position since the recording media having a certain thickness are mostly used. Accordingly, an operation failure of the apparatus due to abrasion of components or decrease in recording quality can be reduced.

Encoder Cover on Rear Side of Carriage

Figure 19:
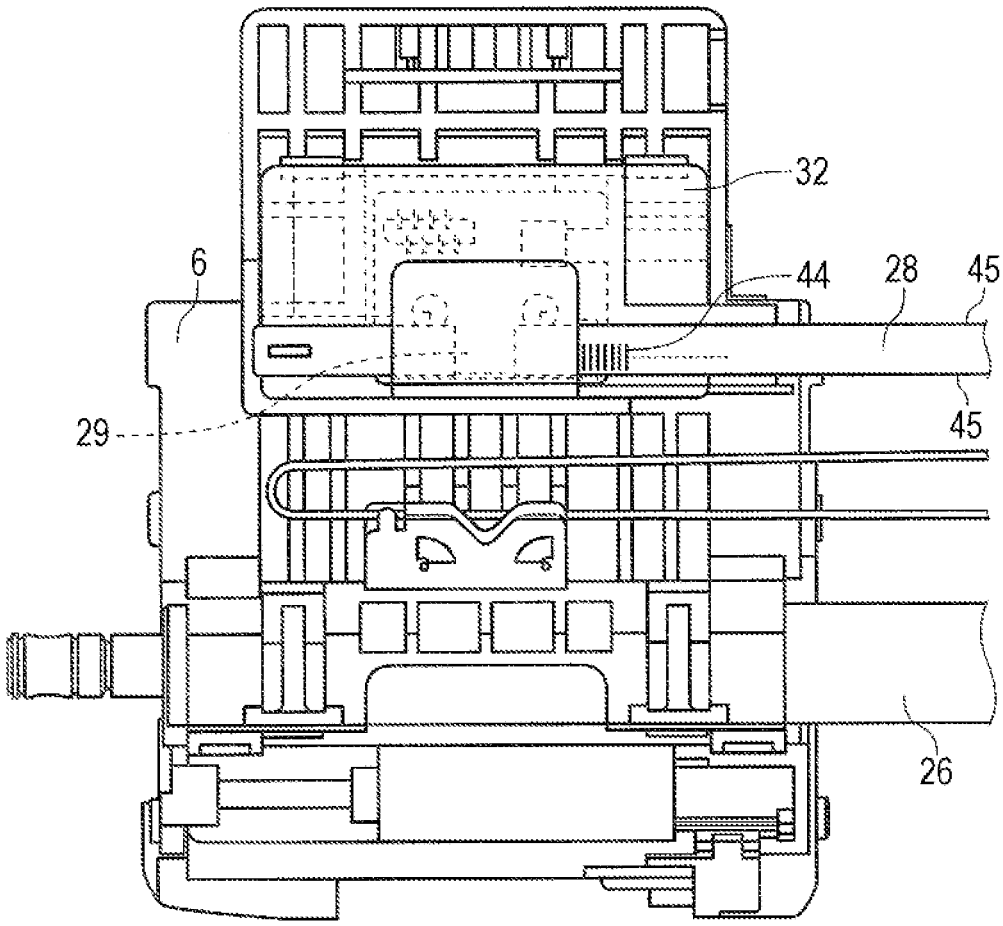
FIG. 19 is a schematic view as seen from the rear side of a carriage of the recording apparatus according to the embodiment.
Figure 20:
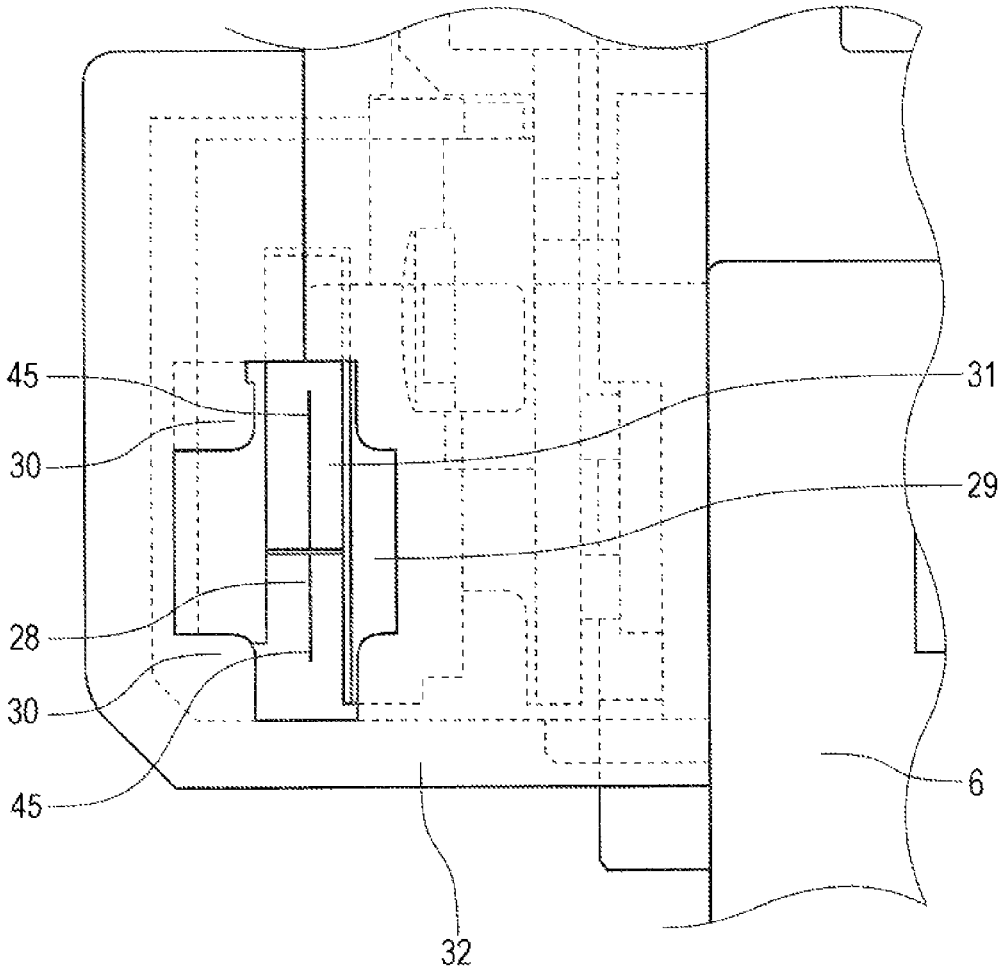
FIG. 20 is a schematic view as seen from the side of the carriage of the recording apparatus according to the embodiment.

Next, an encoder cover disposed on the rear side of the carriage 6 of the recording apparatus 1 according to this embodiment. FIG. 19 is a schematic view as seen from the rear side of the carriage 6 of the recording apparatus 1 according to this embodiment, and FIG. 20 is a schematic view as seen from the side of the carriage 6 of the recording apparatus 1 according to this embodiment.

The recording apparatus 1 according to this embodiment includes an encoder 29 which is disposed on the rear side of the carriage 6 and an encoder cover 32 for preventing ink mist from being attached on the encoder 29. The encoder 29 reads positional information through slits 44 formed on a linear scale 28.

The encoder cover 32 according to this embodiment includes guide sections 30 that serve as a guide during insertion of the linear scale 28 into a linear scale insertion section 31. The guide sections 30 are disposed at positions which correspond to both ends 45 of the linear scale 28 (in this embodiment, upper and lower positions). That is, the guide sections 30 are disposed at positions that do not easily come into contact with the slits 44. When the linear scale 28 is inserted into the linear scale insertion section 31, the both ends 45 of the linear scale 28 are in contact with and guided by the guide sections 30. Accordingly, the linear scale 28 can be prevented from being deformed and the slits 44 can be prevented from coming into contact with the encoder cover 32. It should be noted that other configurations may also be used.

Further, there is a risk that an abnormal noise is generated if the connecting section 9 collides with the flexible member guiding section 47. Accordingly, a recess may be formed or a sound absorbent may be disposed in an area of the flexible member guiding section 47 which corresponds to the connecting section 9 (an area which may oppose the connecting section 9). This configuration can prevent an abnormal noise from being generated.

A supply source of ink which is a liquid to be ejected from the recording head 7 may not be the setting section 3, and may be an ink storing unit which is disposed outside of the housing that houses the recording head 7. Accordingly, the amount of ink can be increased compared with the case using the setting section 3.

In the case where ink is supplied to the recording head 7 from the outside of the housing, the ink supply tube for supplying ink needs to be configured to extend inside the housing. Accordingly, a hole or notch may be provided on the housing so that the ink supply tube extends through the hole or notch. Alternatively, a boss or the like may be provided on the housing to prevent an opening and closing unit such as a scanner unit or a cover which is openable and closable with respect to the housing from being completely closed on the housing so that the tube can extend into the housing through a gap formed by the boss. Accordingly, ink can be supplied through a flow path in the ink supply tube.

The entire disclosure of Japanese Patent Application No.: 2013-071602, filed Mar. 29, 2013 and 2013-192660, filed Sep. 18, 2013 are expressly incorporated by reference herein.

What is claimed is:

1. A recording apparatus comprising:

a housing;

a recording head that is disposed in the housing and is capable of recording by ejecting ink onto a recording medium;

a carriage that is movable in a reciprocating manner with the recording head being mounted on the carriage;

an ink storing unit that is disposed outside of the carriage;

a flexible tube that deforms in response to a movement of the carriage and through which ink contained in the ink storing unit is supplied to the recording head;

a frame that is disposed in the housing;

an arm that is connected to the frame, supports the tube, and is swingably movable in response to the movement of the carriage; and a connecting section that has a holding section which holds the tube, wherein the connecting section is slidably engaged with the arm, and an orientation of the connecting section varies as the connecting section slides along the arm in response to movement of the carriage.

2. The recording apparatus according to claim 1, wherein the arm is disposed outside with respect to the curved tube, and the recording apparatus further includes a biasing section that biases the arm toward the outside.

3. The recording apparatus according to claim 1, wherein supporting members that support curvature of the tube at both ends of the tube are located at upper and lower positions.

4. The recording apparatus according to claim 3, wherein the supporting members that support the curvature of the tube at both ends of the tube are located at upstream and downstream positions in a transportation direction of the recording medium.

5. The recording apparatus according to claim 1, further comprising: a flexible member guiding section that is fixed to the frame;

wherein the arm is disposed on the flexible member guiding section, and a recess is formed in an area of the flexible member guiding section which is configured to oppose the connecting section.

* * * * *